US006366219B1

(12) United States Patent
Hoummady

(10) Patent No.: US 6,366,219 B1
(45) Date of Patent: Apr. 2, 2002

(54) METHOD AND DEVICE FOR MANAGING ROAD TRAFFIC USING A VIDEO CAMERA AS DATA SOURCE

(76) Inventor: Bouchaib Hoummady, 57, rue de Bichain, F-89340 Villeneuve la Guyard (FR)

( * ) Notice: Subject to any disclaimer, the term of this patent is extended or adjusted under 35 U.S.C. 154(b) by 0 days.

(21) Appl. No.: 09/443,913

(22) Filed: Nov. 19, 1999

(30) Foreign Application Priority Data

May 20, 1997 (FR) ..... 97 06117

(51) Int. Cl.[7] ..... G08G 1/095
(52) U.S. Cl. ..... 340/907; 340/916; 340/917
(58) Field of Search ..... 340/907, 916, 340/917, 934, 936, 937, 933; 701/117, 118

(56) References Cited

U.S. PATENT DOCUMENTS 4,907,160 A * 3/1990 Duncan et al. ..... 340/907
5,309,155 A * 5/1994 Hsien et al. ..... 340/907
5,444,442 A * 8/1995 Sadakata et al. ..... 340/916
5,617,086 A * 4/1997 Klashinsky et al. ..... 340/907
5,777,564 A * 7/1998 Jones ..... 340/917
6,100,819 A * 8/2000 White ..... 340/907
6,133,854 A * 10/2000 Yee et al. ..... 340/907

* cited by examiner

*Primary Examiner*—John Tweel
(74) *Attorney, Agent, or Firm*—Schnader Harrison Segal & Lewis LLP

(57) ABSTRACT

An improved traffic management process and apparatus. After a camera gathers information, the system automatically extracts important information by image processing and analysis techniques. The system identifies all types of movement including pedestrians and two-wheel vehicles. The process and the apparatus first simulate and validate the strategy prior to its on-site implementation.

19 Claims, 1 Drawing Sheet

METHOD AND DEVICE FOR MANAGING ROAD TRAFFIC USING A VIDEO CAMERA AS DATA SOURCE

FIELD OF THE INVENTION

The present invention relates to a process and a device for the management of road traffic using the video camera as information source.

DESCRIPTION OF THE PRIOR ART

Measurement, regulation and monitoring are the principal tasks in traffic management.

Known as measurement devices are magnetic or inductive loops which are embedded in the roadway. These magnetic loops are formed of insulated copper wire coils of various sections creating a transducer that is sensitive to the presence of the metallic mass of a vehicle in its magnetic field. The sensitivity of the device is defined by the relative variation of the inductance upon passage of the vehicle over the loop and allows its detection. Said magnetic loops require grooving of the pavement for their definitive installation and maintenance. This type of operation is tedious and costly; it does not allow for upgrading nor leave room for any error. The surface tracking zone is relatively small. Installation requires interrupting traffic. All of the measurements derived from the identification of vehicular passage are punctual. The coverage of the surface by the vehicles cannot be evaluated. In the case of a waiting line of vehicles, the lack of vehicular presence over a magnetic loop does not enable identification of said waiting line. Neither pedestrians nor two-wheel vehicles are identified. The measurement is blind. The life expectancy of the magnetic loops is directly dependent on the state of the traffic and the roadway. Magnetic loops do not allow for self-diagnostics.

Known as measurement devices are pneumatic tubes which are in the form of rubber tubes. They are attached to the roadway perpendicular to the flow of traffic. Passage of the wheels of a vehicle causes a punctual compression which creates a pressure change inside the tube which is propagated to the ends so as to actuate an electric information identification contact. The vehicles are counted based on the number of pairs of wheels. These pneumatic tubes do not allow identification of multiple lanes of traffic nor can they distinguish trucks, two-wheel vehicles or pedestrians. The surface tracking zone is relatively small. All of the measurements derived from the identification of vehicular passage are punctual. The coverage of the surface by the vehicles cannot be evaluated. In the case of a waiting line of vehicles, the lack of vehicular presence over the pneumatic tube sensor does not enable identification of said waiting line. The measurement is blind. These pneumatic tubes are fragile and their life expectancy is very directly linked to the quality of the rubber, to the traffic and vandalism; it can range from several days to several months.

Known as measurement devices are piezoelectric sensors which are coaxial shielded cables constituted by a core and a copper sheath which are insulated from each other by a piezoelectric ceramic. Prior to their insertion in the roadway, these sensors must be packaged in a resin bar, the length of which corresponds to the width of the roadway. The weight of a vehicle creates a pressure variation which allows identification. Installation requires a specialized staff and traffic must be stopped for several hours. These piezoelectric sensors are sensitive to the mechanical stresses created by the pressure of the vehicles'wheels in the upper layer of the roadway. The installation must be maintained in accordance with very strict guidelines (the roadway must at all times be sound, clean and intact). The surface tracking zone is relatively small. All of the measurements derived from the identification of vehicular passage are punctual. The coverage of the surface by the vehicles cannot be evaluated. In the case of a waiting line of vehicles, the lack of vehicular presence over the piezoelectric sensor does not enable identification of said waiting line. The measurement is blind. Piezoelectric sensors do not allow for self-diagnostics.

Known as measurement devices are radar and ultrasonic sensors which identify a vehicle by the reflection of an emitted wave. The backscattered wave returns with a frequency shift that allows identification of the direction and the speed of the moving object. The surface tracking zone is relatively small. All of the measurements derived from the identification of vehicular passage are punctual. The coverage of the surface by the vehicles cannot be evaluated. In the case of a waiting line of vehicles, the lack of vehicular presence in the wave field does not enable identification of said waiting line. The measurement is blind.

Known as measurement devices are magnetic sensors which operate by means of an analysis of the variation of the magnetic field of the ground induced by passage of a vehicle. The surface tracking zone is relatively small. All of the measurements derived from the identification of vehicular passage are punctual. The coverage of the surface by the vehicles cannot be evaluated. In the case of a waiting line of vehicles, the lack of vehicular presence on the sensor does not enable identification of said waiting line. The measurement is blind.

Known as measurement devices are video sensors which identify the passage of a vehicle by means of an analysis of the variation in lighting on predefined lines. The surface tracking zone is relatively small. All of the measurements derived from the identification of vehicular passage are punctual. The coverage of the surface by the vehicles is not evaluated.

Regulation of road traffic by means of the signaling of three-color traffic lights comprises using a control unit, called an intersection controller, to control the changes in state of the signals and the duration of the states at the predictable or random demand of the group of users. Certain controllers schedule the green-light time in a cyclical and definitive manner. They do not take into account the demand. Certain controllers schedule the green light signal according to a signaling program selected in relation to the day and time. The signaling program's are contained in memory in a library of programs that have been previously calculated in relation to the traffic measured by magnetic loop type sensors or by direction counting surveys performed manually by monitors. The traffic variations are of two types: the regular predictable variations and the exceptional and random variations. These latter variations can be notable from one day to the next for the same hourly period. Certain controllers are capable of evaluating these variations from the consequences that they generate several minutes later based on the installation of magnetic loops at the entries and exits of each intersection to be regulated. The measurements employed stem from sensors whose surface tracking zone is relatively small. The lack of spatial information means that all of these regulation systems remain blind, such that they are unable to take into account the local and temporal details that influence the congestion and the spatial capacity of the intersection, section and road network. Collection of data based on the flow rate does not allow detection of the regulation and traffic circulation disturbances. Certain cities install cameras in the so-called critical traffic circulation intersections for manual monitoring of the road traffic to supplement information stemming from magnetic loops installed under the road surfaces. Congestion indicators are displayed on a control light panel to attract the attention of the traffic technician who interrupts his tasks in process in order to select the camera corresponding to the intersection and control the display of the images in order to diagnose the type of traffic situation and to manually actuate the controller of the intersection in question.

Video monitoring devices are known which comprise a series of cameras linked to a display panel which has a series of display screens enabling an operator to monitor a certain number of sites entering in the cameras' fields. Such a device allows a single operator to perform monitoring of a large number of sites, such that the number of monitored sites can be larger than the number of display screens. The role of the operator is to monitor the various traffic disturbances so as to be able to act on the controllers of the three-color traffic light signals. The cameras allow the operator to understand the traffic phenomena. The video is received at the central station of the streets department over special cables (fiber optic or coaxial cables). Video recorders continuously record the traffic so as to allow, in the case of problems, the redisplay of the cassette for identification.

This type of monitoring is very tedious and costly, particularly when the events being monitored occur at a low frequency and the operator's attention is therefore seldom required. This type of disturbance monitoring is not automated with regard to identification and making a regulation decision. In addition, a display of this type does not allow retrospective monitoring of the unfolding of the events in the case of a traffic disturbance. Specifically, in the case of accident, formation of waiting lines, rapid creation of traffic jams, gridlock, going through red lights, increased pollution or increased nuisance, it is not possible to reconstruct with certainty the circumstances that led to the disturbance.

Each traffic management task has these devices available. The use of the camera is limited to human observation purposes by an operator of the traffic operations.

SUMMARY OF THE INVENTION

A goal of the device and process of the invention is improvement of the traffic management by including the camera as information source and automating the extraction of the useful information by image processing and analysis techniques performed on the video images of the traffic and circulation. The improvement of the traffic management begins by:

- Automatically measuring the road traffic movements.
- Automatically diagnosing the regulation operation and its deficiencies.
- Remotely controlling the three-color traffic signals by automatically taking into account the spatiotemporal information (vehicular surface coverage in time) on the road traffic movement stemming from the devices of the invention.
- Automatically monitoring the events and their origins that could be relevant to the traffic manager.

In order to achieve this goal, it is provided according to the invention for the integration of the device on site for measurement and diagnostics, for regulation and monitoring by using in a general manner the images from the cameras installed in the site in question and using the information relative to the operating of one or more intersection traffic lights.

A goal of the present invention is to resolve the shortcomings, as cited in the introduction, of the presently available devices and to provide multiple advantages such as:

In measurement and diagnostics:

- The identification of the passage of a vehicle yields punctual information so as to have compatibility with the present measurements and spatiotemporal information linked to the roadway surface occupied by the vehicle.
- The new spatiotemporal measurements make it possible to obtain new magnitudes of the road traffic for evaluation, for example, of the waiting lines, traffic jams and gridlock.
- The measurement and diagnostic zones are not fixed.
- The lack of a requirement for civil engineering to define the measurement and diagnostic zones.
- The process allows identification of all types of movement such that pedestrians as well as two-wheel vehicles can be identified.
- Everything measured in the video scene is visible; thus, the measurement is not blind.
- Reduction in grooving.
- Reduction in inconvenience for users.
- Maintenance is easy.
- Automation of all types of counting including directional counting so as to obtain the origin-destination matrix which is useful for the regulation of the three-color traffic lights.
- Evaluation of the efficacy of regulation strategies.

In regulation:

- Regulation taking into account the surface coverage so as to optimize the capacity of the road network.
- Take into account the instantaneous demand of the traffic.
- Take into account the movements in the center of the intersection and in all zones seen by the camera.
- Take into account turning movements.
- Facilitate the development of regulation strategies according to the objectives of the manager.
- Simulate and validate the strategy prior to its on-site implementation.
- Better manage the congestion.
- Reduce the costs of traffic regulation.

In monitoring:

- Parameterization and definitions of the events.
- Automatic identification of the events.
- Storage in memory of the origin and beginning of noteworthy events.
- Maintenance of traffic.
- Lack of consumables.
- Remote transfer of the events.

DETAILED DESCRIPTION OF THE INVENTION

Figure 1:
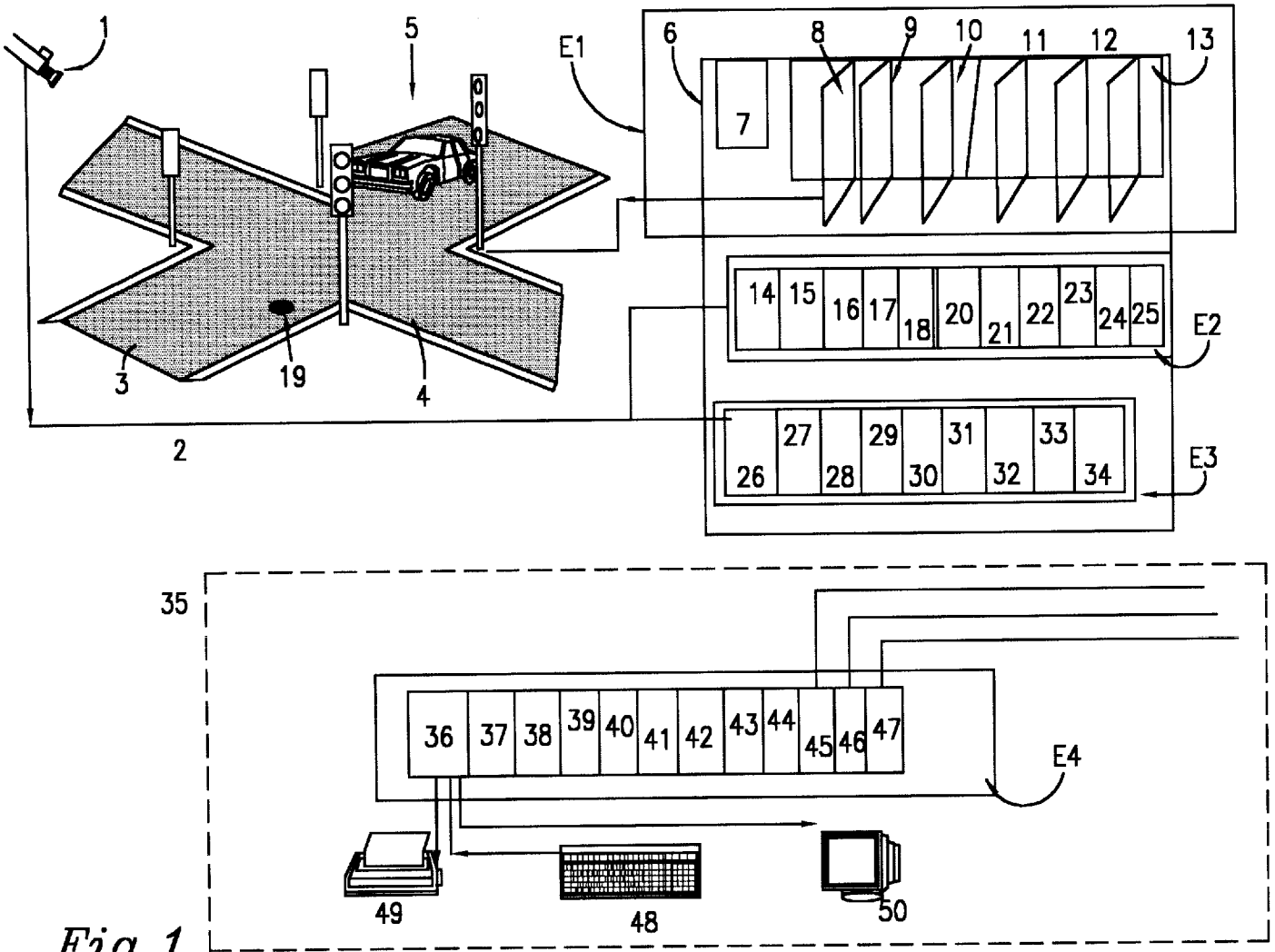
FIG. 1 illustrates how the device is designed to assure management of road traffic according to an embodiment of the invention.

With reference to FIG. 1, the illustrated device is designed to assure management of the road traffic in an intersection 3 using the sole information source: the camera 1, a single example of which has been shown so as not to overload the figure. The circulation in the intersection 3 is maintained by the three-color traffic lights 4.

Part of the device is installed in the cabinet of the three-color traffic light 6 which comprises:

a sector feed 7, an arithmetic and logical unit card 11, the function of which is to manage the cards 8, 9, 10, 12, 13 and to execute the regulation strategy defined by the manager from the control keyboard 48, an input/output card 12 for communication with the second part of the device installed in the central station 35 for receiving new regulation strategies, three-color traffic light control cards 8, a power card 9, a sensor input-output card 10, a telephone communication device 13, video inputs 14, 26, video outputs 15, 29, a video signal enhancement device 16, digitization devices 17, 28, a data storage unit 18, a multiple sensor (pollution, noise, collision, etc.) 19, an image-processing logical unit 20, a decisional unit for the control system 21, series inputs-outputs for communication with a PC 22, modems 23, 33, image storage compression units 24, 31, inputs-outputs for control of the intersection controller 25, an event image, storage unit 27, sensor inputs-outputs 31, series inputs-outputs 30, an event monitoring central unit 32, a buffer-memory 34.

The second part of the device is at the central station of the streets department 35; it is constituted by:

a central unit 36, a video input 37, a video output 38, an image digitization device 39, a storage unit 40, a control system strategy unit 41, a measurement and diagnostics unit 42, an image compression card 43, a simulation unit 44, a controller link 45, a remote control system-measurement link 46, an event monitoring link 47, a control keyboard 48, a printer 49, a screen 50

Operating example of the process according to the invention for the task "traffic measurement" in traffic management.

The video signal of camera 1 is enhanced by video signal enhancement device 16 so as to take into account the changes in light and the various external conditions. The video signal emitted by the device 16 is digitized by digitization device 17 so that it can be processed by the image processing logical unit 20. This processing will reveal all of the zones containing movement in the analyzed scene (vehicles, pedestrians, 2-wheel vehicles, etc.). The unit 20 will represent the movement by the surfaces encompassing the identified objects. A second representation, called the "recent past", is made in the second step of the process comprising the processing and extraction of the useful information. This presentation corresponds to the various surfaces occupied successively in time by the moving objects (vehicles, pedestrians, 2-wheel vehicles, etc.). This presentation reveals the direction of movement, the instantaneous speed, the instantaneous acceleration and the various spatiotemporal coverages on the presently occupied surfaces and encompassing the identified objects. The result of this latter representation is compressed by image storage compression unit 24 so as to reduce its size to be stored in memory in the storage unit 18.

The steps corresponding to one cycle are:

acquisition of the video signal by the camera, -enhancement, digitization, extraction of the moving zones, modeling of the movement and compression, of the resultant image, storage.

The duration of the cycle varies depending on the objectives to be attained (100 ms to 300 ms). The storage unit 18 has a capacity such that it can store in memory the compressed results of the movement analysis desired by the manager. All data are indexed and dated. The characteristics, the conditions and analysis parameters are also stored in memory at the streets department central station 35. The manager selects using his keyboard 48 the intersection 3 at which he desires to implement traffic measurement and diagnostics. The central unit 36 allows him to identify this intersection and control, via the controller-measurement link 46, the unit 20, to transfer the requested data which are stored on unit 40. The measurement and diagnostics unit 42 allow the manager to decompress using image compression card 43 the spatiotemporal representations corresponding to the various movements and to implement the traffic measurements at the sites that he defines. Two families of measurements are proposed:

Measurements based on counting at a given point:

flow rate, congestion rate, vehicular interval, linear density, punctual coverage rate, apparent speed, concentration are several examples of the types of measurements in this family, Measurements based on the spatial coverage (coverage of the roadway surface):

spatial coverage rate, spatiotemporal coverage rate, spatial clearing rate, spatial fluidity rate, spatial saturation rate, stop time, average clearing rate, length of waiting line, average waiting time, directional counting, crossing time.

Upon completion of the extraction of the moving surfaces, the manager can perform and repeat all types of measurements at various sites. This provides a noteworthy advantage.

The unit 43 allows the manager to analyze the operation of the intersection so as to be able to detect the presence or lack of dysfunction in the regulation, the circulation or the road safety in the intersection analyzed. The traffic measurements are performed in the following manner:

determination of the analysis zones, determination of the types of measurements, determination of the presentation forms of the results, animation in real time of the movements of the spatiotemporal surfaces representing the vehicles and objects identified in the scene, extraction of the programmed measurements and exploitation of the results.

This evaluation process in accordance with the invention makes it possible to measure everything that is visible and to see that which is measured. Thus, the measurement is not blind. The process of the invention has the advantage that the manager can remeasure a given magnitude without having to refilm and reprocess the scene. The measurement is thus reproducible and not blind. The measurement zones can be modified at will.

The traffic regulation or circulation strategy simulation unit allows the manager to define:

the regulation or circulation strategy, the measurable magnitudes as well as their thresholds intervening in the state changes of the three-color traffic lights, the traffic-light programs and the state change conditions.

On the basis of these data, the unit can simulate the regulation, the road circulation and the state changes in the traffic lights of said site using the previously extracted measurements. New measurements are performed during this simulation. These measurements allow evaluation of the strategy so that it can be optimized. This simulation is visible on the monitor 50. The simulation according to this invention provides the advantage that one can see how the intersection risks to operate, to analyze and measure the movements for validation of the manager's strategy so that he can implement this strategy by means of a simple transfer via the link 45 of the new traffic light programs to the controller corresponding to E1. The new traffic light programs are stored in the memory of E1. The unit 11 executes the new strategy. Based on the remote controller measurement link 46 and 30, the manager control the transfer of the magnitudes and measurements of regulation as well as their thresholds intervening in the changes of the performance of the traffic-light program; it transfers the analysis zones and the set of parameters that are useful in the operation of unit 20 and the equipment group E2.

Operating example of the process according to the invention for'the task "traffic regulation" in traffic management.

The video signal from the camera 1 is enhanced by video signal enhancement device 16 so as to take into account the changes in light and the various external conditions. The video signal emitted by the device 16 is digitized by digitization device 17 and processed by the image-processing logical unit 20. This processing will reveal all of the zones containing movement in the analyzed scene (vehicles, pedestrians, 2-wheel vehicles, etc.).

The unit 20 represents the movement by the spatiotemporal surfaces encompassing the identified objects. This presentation corresponds to the various surfaces occupied successively in time by the moving objects (vehicles, pedestrians, 2-wheel vehicles, etc.). Operation of the remote control system requires definition of: the decisional zones, the decisional magnitudes, the decisional thresholds affected at each magnitude, the logic for the remote control system corresponding to the decisional limits and thresholds reached. This information is stored in buffer memory and protected such that it will not be lost in the case of power failure. This memory is part of the decisional unit for the control system 21.

The decisional zones in an intersection can be, for example, the entries, the exits, the waiting lines at the entries, the waiting lines at the exits, the left turns, the center of the intersection, the occasional parking zones, the passenger passages. The zones can be: the cycle zones, the pedestrian zones, the entrances-exits of public or private institutions, public or private places.

The decisional magnitudes and measurements can be: the flow rate, the saturation flow rate, the vehicle interval, the linear density, the punctual coverage rate, the apparent speed, the concentration, the spatial coverage rate, the spatiotemporal coverage rate, the spatial release rate, the spatial fluidity rate, the spatial saturation rate, the stopping time, the average release time, the waiting line length, the average waiting time, the directional flow rate, the crossing time.

The decisional thresholds assigned to the selected measurements are the values corresponding to the extreme limits for entering into the decision logic. The decision logic is composed of comparison operators (AND, OR, MAXIMUM, MINIMUM, etc.), condition operators (IF, IF NOT, etc.) and action operators (CLOSE, OPEN, TURN ON LIGHT, TURN OFF LIGHT, SLOW DOWN, POSITION, STOP, RELEASE, etc.).

The strategy corresponding to the objective that the manager wishes to achieve in terms of road traffic regulation and circulation such as: optimization of an intersection with traffic lights operating on a fixed cycle, adaptivity as a function of conflict sites, gridlock prevention, traffic jam prevention, adaptivity in relation to the saturation rate, the fluidity-safety, adaptivity in relation to directional movements, adaptivity in relation to pedestrian crossing time, optimization of time wasted in front of traffic lights, adaptivity in relation to road work sites, pedestrian safety. The multiple strategy nature of the invention provides the advantage of being able to use the same equipment and a single installation for present as well as future needs.

The unit 21 scans each zone in order to identify the spatiotemporal coverage for the movement of vehicles, pedestrians, two-wheel vehicles, etc. The unit 21 evaluates the measurements of the selected magnitudes which correspond to the programmed zones. It identifies the thresholds that have been reached and informs via the output sensor 31 and the card 10 the central unit of the intersection controller for its remote control system and the execution of the three-color traffic light programs corresponding to the state of the programmed strategy.

The spatiotemporal presentation corresponding to the various surfaces occupied successively over time by the moving objects (vehicles, pedestrians, 2wheel vehicles, etc.) is compressed by image storage compression unit 24 so as to reduce its size for entry in the storage unit 18 memory. The traffic measurements can be performed on the latest days. This number of days is a function of the size of the memory of the unit 18.

Operating example of the process according to the invention for the task "automatic monitoring of events and traffic maintenance" in traffic management.

From the control keyboard 48 and the equipment E4, the traffic manager identifies the intersection to be monitored, specifies the critical zones, selects the measurements and thresholds entering into the decision, identifies the associated sensors 19, 1 and details the objects and relevant factors to be monitored. This parameterization is transferred to the event monitoring unit 32 by the links 47 and 30

The defined object of the monitoring can be, for example, detection of prohibited parking, incident detection, detection of the crossing of continuous lines stops and red lights, detection of waiting pedestrians, detection of vehicles going in the opposite direction, detection of the formation of waiting lines, detection of the formation of saturation, detection of the origin of pollution, detection of the origin of noise or collision, detection of graffitists, detection of the origin of saturation in the intersection direction, detection of regulation irregularities.

For the implementation of the event-monitoring process of the invention, there is provided in accordance with the invention, a video-based monitoring device comprising at least one camera 1 linked to an image digitization unit 98 associated with an event detector 19, 20 and a buffer memory 34 for storing digitized images. A storage unit 27 for the compressed images 31 of the identified events is linked to the buffer memory. The event-monitoring central unit 32 manages this set of elements.

The buffer memory allows temporary storage of a series of continuously updated images such that the series of images in the buffer memory corresponds at all times to the recent past of the event that occurred and was detected by 19, 20. Thus, by transferring after compression by image storage compression unit 31 the contents of the buffer memory into the storage memory upon appearance of an event, it is assured that the storage memory only contains series of images related to the abnormal events and the visualization of the storage memory can thus be implemented very rapidly so as to locate the images of greater interest.

The device according to an embodiment of the invention makes it possible to implement the process which comprises temporarily storing the digitized images in the buffer memory. Each new image entered in the buffer memory replaces the oldest image in this buffer memory such that the buffer memory is continuously updated so as to correspond at all times to the latest images taken. The duration of, the image sequence in the buffer memory is a programmable parameter as is the duration of the inter-image interval. When an event is detected by the associated sensor, for example, when the formation of a waiting line is detected in a circulation lane or, for example, a form of directional pollution is detected, the set of images contained in the buffer memory is compressed and transferred into the storage memory. Simultaneously, an alarm is transmitted to the traffic management center, such that the operator can immediately view the sequence of images entered into the storage memory. The storage in memory of the images preceding the event is particularly advantageous in the case of a regulation dysfunction or in the case of monitoring incidents because it enables not only the retrospective determination of the causal factors at the origin of the incident but also analysis of the circumstances that cause types of events and, where applicable, modification of the profile of the routes of the site so as to eliminate or at least minimize the irregularities.

It is possible to associate several sensors with a camera and an event-monitoring unit. Thus, all of the sensors can have a visual memory. The process provides other advantages with regard to event monitoring:

Intelligent and automated monitoring allows storage in memory of noteworthy phenomena, Lack of consumables, Recording uniquely at the beginning of the events, Instantaneous researching of the events.

While the invention has been described with specificity, additional advantages and modifications will readily occur to those skilled in the art. Therefore, the invention in its broader aspects is not limited to the specific details shown and described herein. Accordingly, various modifications may be made without departing from the spirit or scope of the general inventive concepts as defined by the appended claims and their equivalents.

What is claimed is:

1. A road traffic management process comprising:

acquiring information in the form of video images with a camera, extracting a part of the information by image processing and controlling three-color traffic lights by taking into account said information, simulating step strategies for regulating the states of the three-color traffic lights, evaluating the best regulation strategy, and transferring the programs for the three-color traffic lights corresponding to the best strategy selected.

2. The process according to claim 1, characterized in that it includes one or more cameras as an information source and automates extraction of the useful information by image processing and analysis techniques performed on the video images of the traffic and circulation, according to which on the basis of the information automatically extracted from the video images, the following is performed on decisional zones in an intersection automatic measuring of decisional magnitudes from the detection and extraction of the movements in the traffic circulation, automatic diagnosis of the operation of the regulation and its deficiencies based on these zones and magnitudes, remote control, according to decisional logic, of the three-color traffic lights by automatically taking into account the spatiotemporal decisional information, magnitudes and measurements in the decisional zones, automatic monitoring of the events and their origins which could be of interest in the decisional zones using the thresholds that can be parameterized on the magnitudes.

3. The process according to claim 1, further comprising:

digitizing the video image to obtain a digitized image and extracting from the digitized image the set of zones in movement in the analyzed scene by spatiotemporal comparison of characteristics corresponding to the objects in movement in the images, and representing, in a first phase, movement by the surfaces encompassing the identified objects and in a second phase "the recent past" corresponds to the various surfaces covered successively in time by the moving objects by calculation of the various spatiotemporal coverages in the surfaces presently covered and encompassing the identified objects.

4. The process according to claim 1, characterized in that it recalculates as needed on decisional zones in an intersection that can be parameterized and from surfaces of identified moving objects in the processed images the decisional measurements of punctual and spatiotemporal traffic.

5. The process according to claim 1, characterized in that it:

simulates the regulation strategies, road circulation and changes in the states of the three-color traffic-lights of the site using previously extracted decisional measurements, evaluates the best strategy corresponding to the regulation site by comparison and recalculation of the measurements given by each of the strategies, transfers to a controller (E1) the programs for the three-color traffic-lights and the conditions for changing the states corresponding to the strategy developed and selected for the objective to be attained by the manager of the regulation and road circulation such as: optimization of an intersection with three-color traffic lights with fixed cycles, adaptivity in relation to conflict sites, gridlock prevention, traffic jam prevention, adaptivity in relation to the saturation rate, the fluidity-safety, adaptivity in relation to directional movements, adaptivity in relation to pedestrian crossing time, optimization of time wasted in front of the three-color traffic lights, adaptivity in relation to road work sites.

6. The process according to claim 1, further comprising assigning decisional thresholds to selected measures, said decisional thresholds being values corresponding to extreme limits to be taken into account in the decision logic.

7. The process according to claim 1, characterized in that decisional zones in an intersection with regard to identification or measurement or regulation or monitoring in the circulation site are not fixed and correspond to a site of interest selected from the group consisting of the entries to an intersection or traffic circle, the exits, the waiting lines at the entries, the waiting lines at the exits, the left turns, the center of the intersection, the occasional parking zones, the pedestrian passages, the cycle zones, the pedestrian zones, the entrances-exits of public or private institutions, and public or private places.

8. The process according to claim 1, characterized in that the process uses decisional magnitudes and measurements which are: the flow rate, the saturation flow rate, the vehicle interval, the linear density, the punctual coverage rate, the apparent speed, the concentration, the spatial coverage rate, the spatiotemporal coverage rate, the spatial release rate, the spatial fluidity rate, the spatial saturation rate, the stopping time, the average release time, the waiting line length, the average waiting time, the directional flow rate, the crossing time and any other measurements composed of the cited measurements.

9. The process according to claim 1, characterized in that the process uses decision logic which is composed of:

comparison operators (AND, OR, MAXIMUM, MINIMUM, GREATER THAN, LESS THAN, PRESENCE, ABSENCE, etc.) on the decisional measurements in the zones of interest, condition operators (IF, IF NOT, etc.), action operators (CLOSE, OPEN, TURN ON LIGHT, TURN OFF LIGHT, SLOW DOWN, POSITION, STOP, RELEASE, INFORM, etc.) on the interfaces and action material equipment for measurement, regulation and monitoring.

10. The process according to claim 1, characterized in that the regulation strategy includes regulation of traffic circulation which comprises:

in a first initialization step:

definition of the decisional zones in the video images of the regulation site, definition of the decisional magnitudes and measurements by zone, establishment of optimal strategy corresponding to the regulation of the site, establishment of the programs for the three-color traffic lights corresponding to the optimal regulation strategy, definition of the decisional logic by zone,—in a second repetitive operating step:

extraction from the video images from the cameras (1) of the corresponding moving surfaces, calculation of the decisional measurements in the programmed zones, execution of the decisional logic, activation according to the decisional logic of the intersection controller (E1), execution of the program for the three-color traffic lights corresponding to the result of the decisional logic.

11. The process according to claim 1, characterized in that the process identifies a number of decisional zones which can reach at least 200.

12. The process according to claim 1, characterized in that the process includes automatic event monitoring which comprises:

a parameterization step characterizing, by the magnitudes and a decisional logic, an event in each programmed zone, a second repetitive step extraction from the video images from the cameras of the corresponding moving surfaces, temporary storage in a buffer memory of the digitized images of a video sequence of a duration that can be parameterized such that each new image introduced into the buffer memory replaces the oldest image, automatic identification of the events with storage of a video sequence containing the last seconds before detection of the event and several seconds afterwards, remote transfer in the case of identification of the images of events,—signaling of an alarm, in the case of identification of an event, to the connected devices.

13. A global or partial road traffic management system (measurement, regulation, monitoring) by video camera formed of an assembly of interconnected electronic equipment for the implementation of the process according to claim 1, comprising:

a first assembly of equipment (E1) installed in a cabinet of the three color traffic light which comprises an arithmetic and logical unit card, the function of which is to execute the regulation strategy defined from the control keyboard, an input/output card for communication with the second part of the device installed in the central station for receiving new regulation strategies, three-color traffic light control cards, a power card, a sensor input-output card, a telephone communication device, video inputs, video outputs, an image-processing logical unit, an assembly of equipment (E4) installed at the central station of the streets department constituted by a central unit, a video input, an image digitization card, a storage unit, a control keyboard.

14. The system according to claim 13, characterized in that it controls said assembly of equipment (E4) for recalculation on request on decisional zones in an intersection that can be parameterized of the punctual and spatiotemporal traffic measurements.

15. The system according to claim 13, characterized in that it controls a simulation unit for simulation of a strategy for regulation, road circulation and changes in the three-color traffic light signaling states in an intersection using previously extracted measurements and transfers the programs for the three color traffic light and the conditions of the state changes corresponding to the strategy developed and selected to first assembly (E1).

16. Apparatus (E2) installed on site in regulation cabinets of the three-color traffic lights for the implementation of the process according to claim 1, characterized in that it automatically extracts the useful information in the video images, controls a controller (E1) and an assembly (E3) and remotely controls controller (E1) relative to decisional zones in an intersection, decisional magnitudes, decisional thresholds assigned to each decisional magnitude and the logic for the control system corresponding to the decisional limits and thresholds reached.

17. The system according to claim 13, characterized in that it is controlled by an assembly of equipment (E3), stores certain events in memory, identifies when said stored events occur, and controls the assembly (E3) for the transfer of said video outputs which occur at the beginning of said events.

18. Apparatus (E2) installed on site in regulation cabinets of the three-color traffic lights for the implementation of the process according to claim 1, characterized in that it extracts from a digitized image a set of zones in movement in the analyzed scene and represents in a first phase the movement by the surfaces encompassing objects identified as moving in the analyzed scene and in a second phase "the recent past" corresponds to the various surfaces occupied successively over time by the moving objects by the calculation of the various spatiotemporal occupancies in the surfaces presently occupied and encompassing the identified objects which will be stored in a backup unit.

19. Apparatus for implementation of the process according to claim 1 installed on site in regulation cabinets of the three-color traffic lights controlled by an assembly of equipment (E4) by means of a keyboard for specifying critical zones, for selecting the measurements and thresholds intervening in the decision, for identifying associated with the site and for detailing the objects and relevant factors to be monitored for their parameterization and controlled by (E2) for storage in the memory of a storage unit not corresponding to a video cassette solely the recent past and the beginning of each event in relation to the object of the monitoring such as: prohibited parking, incident detection, detection of the crossing of continuous lines, stops and red three-color traffic lights, detection of waiting pedestrians, detection of vehicles going in the opposite direction, detection of the formation of waiting lines, detection of the formation of saturation, detection of the origin of pollution, detection of the origin of noise or collision, detection of graffitists, detection of the origin of saturation in the intersection direction, detection of regulation irregularities.

* * * * *